United States Patent [19]

Boden

[11] 4,101,981

[45] Jul. 25, 1978

[54] VENTILATED HAT OR CAP

[76] Inventor: Ogden W. Boden, 1580 Gaywood Dr., Altadena, Calif. 91001

[21] Appl. No.: 787,839

[22] Filed: Apr. 15, 1977

[51] Int. Cl.[2] ..... A42B 1/00

[52] U.S. Cl. ..... 2/182.6; 2/171.3; 2/197

[58] Field of Search ..... 2/171.3, 181, 181.2, 2/182.1, 182.6, 182.7, 183, 177, 175, 195, 197, 182.5, 181.4, 171.7, 173.5

[56] References Cited

U.S. PATENT DOCUMENTS

| | | | |
|---|---|---|---|
| 663,311 | 12/1900 | Verhoeven et al. | 2/182.1 X |
| 1,566,891 | 12/1925 | Lyon | 2/181 X |
| 3,780,382 | 12/1973 | Boden | 2/182.6 |
| 3,925,821 | 12/1975 | Lewicki | 2/171.3 X |

FOREIGN PATENT DOCUMENTS

| | | | |
|---|---|---|---|
| 283,240 | 1/1914 | Fed. Rep. of Germany | 2/197 |
| 492,254 | 9/1938 | United Kingdom | 2/181 |
| 1,019,556 | 2/1966 | United Kingdom | 2/197 |

*Primary Examiner*—Peter Nerbun
*Attorney, Agent, or Firm*—William P. Green

[57] ABSTRACT

A hat or cap having a crown with ventilation openings including a top opening beneath which a baffle is supported movably, and with the band of the hat or cap having spacer elements which engage the user's head at different locations in a manner holding the band out of contact with at least the front and side portions of the user's head, and with the band containing one or more stiffening elements for maintaining the shape of the band while thus spaced from the head.

18 Claims, 12 Drawing Figures

VENTILATED HAT OR CAP

BACKGROUND OF THE INVENTION

This invention relates to improved hats or caps which are constructed to permit the circulation of air relatively freely to and from a person's head in use, in order to cool the head and also prevent soaking of the hat or cap with perspiration.

In my prior U.S. Pat. No. 3,780,382, issued Dec. 25, 1973 on "Hat Or Cap Constructed For Air Circulation Therethrough", I have shown certain head gear arrangements in which openings or passages are provided for enabling relatively free flow of air into and out of a hat or cap to maintain the head of the user in a cool condition while at the same time covering the head sufficiently to protect it against direct exposure to the sun's rays. One important feature of the cap shown in that Patent resides in the provision of a hat band structure which, at the front of the user's head, is held in space relation to the user's head by a pair of spacers projecting inwardly from the hat band into contact with the head, to thereby provide a passage through which air may flow upwardly into the cap or downwardly therefrom adjacent the user's head. This space desirably continues along the opposite sides of the user's head, with an adjustable connector strap being provided at the back of the head for adjusting the band to different size heads. In that prior arrangement, the two spacer elements carried by the front portion of the hat band are desirably mounted for universal pivotal movement relative to the hat band.

SUMMARY OF THE INVENTION

A hat or cap constructed in accordance with the present invention desirably utilizes a hat band which is spaced from the user's head in the above discussed manner at the front and sides of the head, and in some forms of the invention is also spaced from the back portion of the head. To assure continuous maintenance of the desired circulation space between the band and the user's head, the invention preferably provides in the band structure one or more stiffening elements which maintain the shape of the band in a manner preventing it from flexing inwardly into engagement with the user's head at locations offset from the points at which the head contacting elements are located. Desirably, each stiffening element takes the form of an elongated wire, preferably formed of spring metal, though it is contemplated that a suitably stiff resinous plastic material may be employed if desired. In some instances, one such wire or element will satisfactorily serve the stiffening purpose, while in other cases two vertically spaced wires may be employed.

An additional feature of the invention resides in a unique arrangement for attaching the spacer elements to the hat band for relative universal movement. In particular, such mounting may be achieved in extremely simple fashion by forming each of the spacer elements to have an enlarged inner portion which contacts the user's head, and an outer portion projecting outwardly toward the hat band and containing an opening through which connector material can extend for securing the spacer element to the hat band movably. This arrangement may be formed by simply sewing the spacer element to the band by thread extending through the opening in the element, or by providing a wire loop extending through a portion of the hat band and through the opening in the spacer element.

As a further feature of the invention, I form in the top portion of the crown of the hat or cap a central opening through which air can circulate into and out of the interior of the cap, with a baffle being carried by the crown and spaced beneath the opening to enable free flow of air past the edge of the baffle while the baffle blocks direct passage of sunlight into the hat or cap through the top opening. A baffle of this type is shown in one of the forms of the invention of my prior U.S. Pat. No. 3,780,382, but in that arrangement was mounted in fixed position relative to the opening by essentially stiff connector elements. The present invention improves on that arrangement by connecting the baffle to the crown in a relation enabling upward movement of the baffle relative to the crown when contacted by a user's head. As a result, the baffle may in most instances hang downwardly at the desired ventilating spaced position, but at the same time be free for upward movement if and when the cap or hat may be utilized by a person whoe head requires such upward movement.

BRIEF DESCRIPTION OF THE DRAWING

The above and other features and objects of the invention will be better understood from the following detailed description of the typical embodiments illustrated in the accompanying drawings in which.

DESCRIPTION OF THE PREFERRED EMBODIMENTS

Figure 1:
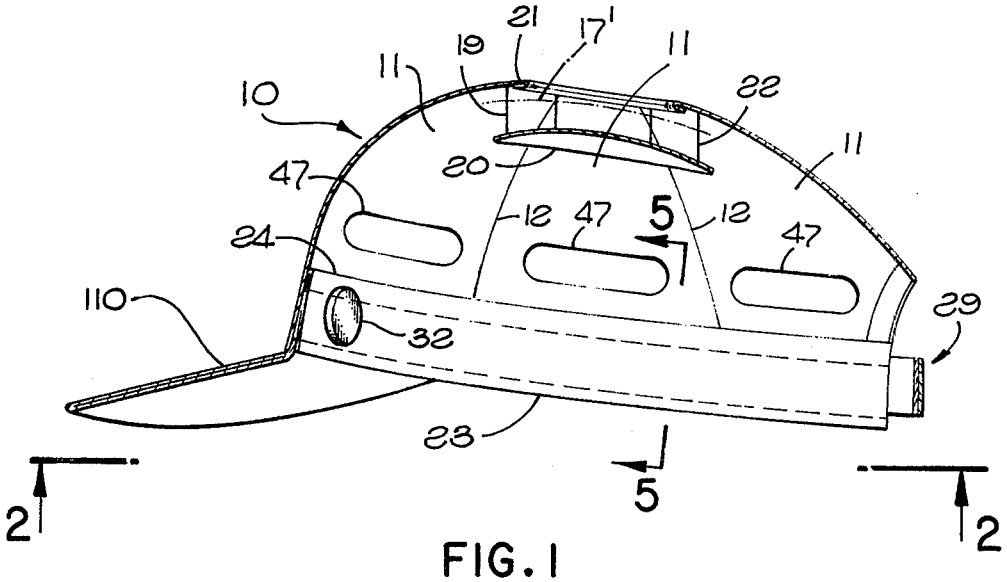
FIG. 1 is a vertical front to rear section through a cap constructed in accordance with the invention.

A first form of cap embodying the invention is illustrated in FIGS. 1 through 5, and includes a crown 10 which extends about a user's head and across the top of the user's head, and which carries a bill 110 projecting forwardly from the crown. The crown may be formed in generally conventional manner from a number of sections 11 stitched together along seam lines 12 which converge toward one another as they advance upwardly to the top of the crown. The various sections 11 may be formed of an appropriate cloth or other material which has flexibility but resists deformation sufficiently to cause the crown to normally maintain its essentially dome shaped configuration illustrated in FIG. 1.

At the center of the uppermost portion of the crown, an opening 13 is formed in the crown, through which air can circulate into and out of the crown from its exterior. To define this opening, the sections 11 of the crown have arcuate upper edges 14 which curve about a vertical axis 15 and are at a common diameter from axis 15 to give the opening 13 a preferably circular shape, with the edges 14 desirably being doubled back and stitched to form a continuous circular bead 16 about opening 13.

Figure 2:
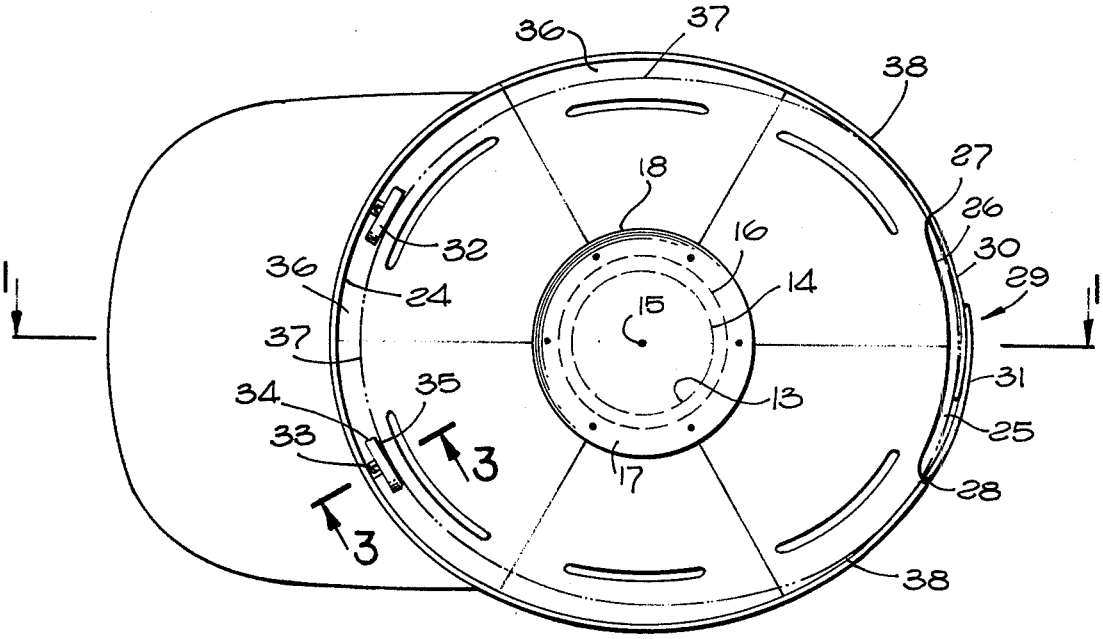
FIG. 2 is a bottom plan view taken on line 2—2 of FIG. 1.

Spaced beneath and in vertical alignment with opening 13, the crown carries a generally horizontal baffle 17, which is circular and of a diameter somewhat greater than that of opening 13, so that the circular peripheral edge 18 of the baffle is located laterally beyond the periphery of opening 15 as viewed in FIG. 2. Baffle 17 may be of upwardly convex curvature and symmetrical about axis 15, as will be apparent from FIG. 1, to curve in general correspondence with the curvature of the vertically opposite portions of the crown. An annular space or gap 19 is formed vertically between the edge portion 20 of baffle 17 and the portion 21 of crown 10 adjacent opening 13, so that air may flow between the interior and exterior of the crown through this passage 19 and top opening 13, while at the same time baffle 17 blocks passage of the sun's rays directly downwardly through opening 13 to the user's head. The baffle may be formed of any suitable desirably opaque material, such as for example a cloth having sufficient stiffness to normally maintain the illustrated shape.

Baffle 17 is high enough in the crown to normally be located above the user's head. However, in the event that the cap is on occasion used by a person whose head projects high enough to contact the baffle, the mounting of the baffle is, in accordance with the present invention, designed to allow the baffle to be displaced upwardly by contact with the head. For this purpose, the baffle 17 is suspended from the top portion of the crown by a number of flexible suspension elements 22, connected at upper ends to the crown and at lower ends to the baffle at locations spaced circularly about axis 15. Each of these suspension elements 22 may consist of one or more threads stitched at upper and lower ends to the crown and baffle, or may be formed of flexible ribbon or the like, or any other appropriate flexible material allowing upward deflection of the baffle as to or upwardly beyond the position represented in broken lines at 17' in FIG. 1.

Extending along the lower edge 23 of crown 10, there is provided a hat band 24 which is continuous about the user's head except at the location of a gap 25 at the back of the cap at which the crown is cut away as represented at 26. More particularly, the band has a first end at the location 27 of FIG. 2, at one side of the gap 25, and from that location extends forwardly at one side of the user's head, then across the front of the head and rearwardly at the opposite side of the head to the location 28 of FIG. 2. The width of gap 25 is adjustable by provision of suitable adjusting strap means 29, which in some instances may take the form of an elastic strap, but preferably include two straps 30 and 31 attached to the cap at the locations 27 and 28 respectively and having connector elements interengageable in any of different positions to adjust the effective combined length of the two detachably interconnectible straps 30 and 31. These straps preferably have VELCRO type interengaging portions 130 and 131, but may instead have snap fasteners, buttons, a buckle, or any other desired type of adjustable fastener elements.

At the front of the user's head, the hat band 24 carries two horizontally spaced head contacting elements 32, which are mounted for universal pivotal movement about centers 33 relative to the hat band. Each of the elements 32 has a desirably circular head portion 34 having an inner planar surface 35 which contacts the user's forehead and by virtue of the universal pivotal movement can shift automatically to an angularity or inclination corresponding exactly to that of the engaged portion of the user's head. Between the locations of the elements 32, the hat band is maintained by elements 32 in horizontally spaced relation to the opposed portion of the user's head, to enable circulation of air upwardly and downwardly through a gap 36 between the hat band and head. In FIG. 2, the contour of the head at the location of the hat band is represented in broken lines at 37. As also seen in that figure, the elements 32 hold the hat band outwardly away from the head at opposite sides of the head, so that the gap 36 continues rearwardly beyond each of the elements 32 and along the sides of the head to locations 38 at which the rearmost portion of the band may contact the head for a short distance, as does the strap assembly 29. The head thus contacts the hat at essentially only three locations, that is, at the locations of front spacer elements 32 and at the back of the head.

Figure 3:
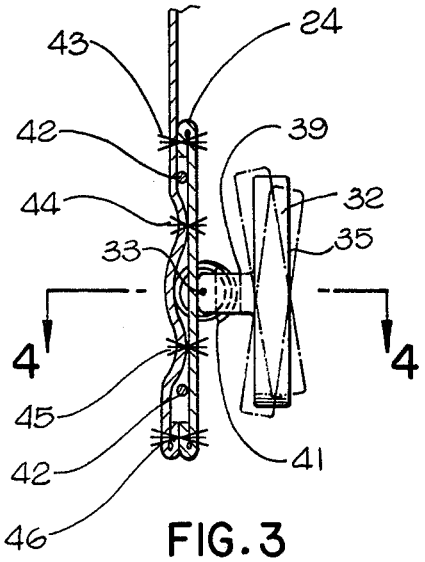
FIG. 3 is an enlarged vertical section taken on line 3—3 of FIG. 2.
Figure 4:
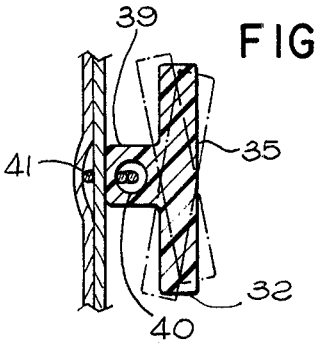
FIG. 4 is a horizontal section on line 4—4 of FIG. 3.
Figure 5:
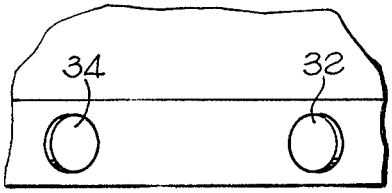
FIG. 5 is a vertical section on line 5—5 of FIG. 1.

As seen in FIGS. 3 and 4, each of the head contacting elements 32 has at the back side of its enlarged head contacting portion 34 a connecting lug 39, containing an opening 40 through which a loop of connecting material 41 extends. In FIG. 3, this loop 41 is illustrated as a loop of wire, which extends through the material of hat band 24 and through opening 40, in a relation enabling the enlarged head contacting portion 34 of each element 32 to swing universally between the various positions illustrated in full and broken lines in FIGS. 3 and 4. In another form of the invention, the loop 41 may be formed of thread, looped several times through the hat band material and through opening 40 to retain element 32 in essentially the same manner in which buttons are sewed to garments. The elements 32 are preferably essentially rigid, to maintain their shape as they swing between the various illustrated positions.

The materials of hat band 24 and the portion of the crown to which the band is secured are normally very flexible, and unless stiffened in some manner would tend to flex inwardly into contact with the user's head at locations between and laterally beyond the spacer elements 32. To prevent such flexure, I provide in FIGS. 3 and 4 a pair of similar vertically spaced parallel stiffening elements 42, which are formed of a material having stiffness substantially greater than that of the hat band 24 and connected portion of the crown together. The elements 42 may be formed of spring wire, desirably stainless steel or other non-rusting material. The elements 32 are located midway between the two vertically spaced wires 42, which are appropriately confined and retained between band 24 and the lower edge portion of the crown by stitching these layers of material together along parallel horizontal seam lines 43, 44, 45 and 46 above and beneath each of the wires. The wires and these seam lines all extend continuously from the location 27 of FIG. 2 to the location 28, so that the wires will maintain the shape of the hat band as it extends about the head and maintain the band in spaced relation to the head, while at the same time allowing the ends of the wires at the locations 27 and 28 to be moved toward and away from one another by adjustment of strap assembly 29 to fit any particular head size.

At a location above hat band 24, the vertically extending portions of the crown contain a series of spaced apertures 47, which may be horizontally elongated as shown, with one of the apertures being formed in each of the sections 11 of the crown, to allow the flow of air horizontally into and out of the cap at the locations of these apertures.

In using the cap of FIGS. 1 to 5, a person can place the cap on his head in a position in which the elements 32 contact the forehead at spaced locations, following which the user adjusts the strap 29 to bring the rear portion of the cap into contact with the back of the head while the elements 32 remain in contact with the front of the head. After once adjusting the cap in this manner, the cap will always contact the head at only the three locations of elements 32 and the rear portion of the cap, to leave the gap 36 across the front and along the sides of the head. Since the hat band is thus maintained out of contact with the head at most locations, the tendency for sweating at the hat band location is minimized, with this effect being enhanced by free circulation of cooling air upwardly and downwardly through gap 36, and into and out of the crown through top aperture 13 and side apertures 47.

Figure 6:
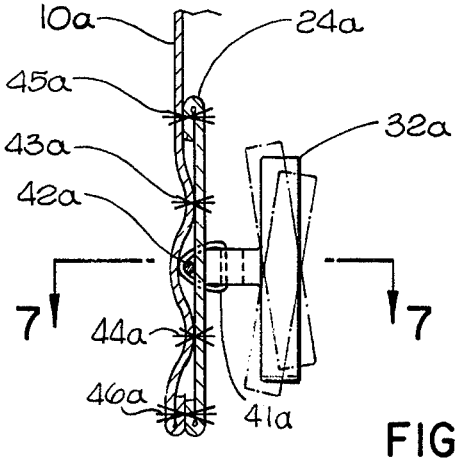
FIG. 6 is a view similar to FIG. 3, but showing a variational form of the invention with a single stiffening wire.
Figure 7:
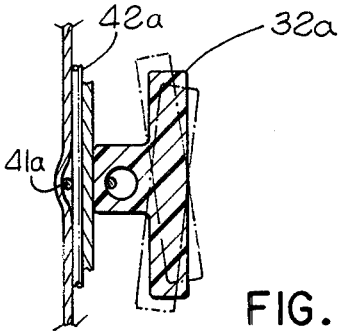
FIG. 7 is a fragmentary horizontal section taken on line 7—7 of FIG. 6.

FIGS. 6 and 7 are similar to FIGS. 3 and 4 respectively, but show a variational arrangement in which only a single stiffening wire **42*a* is provided at approximately the center of the vertical extent of hat band 24*a*, with this single spring wire extending between locations corresponding to those represented at 27 and 28 in FIG. 2, and being retained between the hat band and the adjacent lower portion of crown 10*a* by stitching of these elements together along horizontal seam lines 43*a* and 44*a*. The band and crown may also be stitched together along the upper and lower edges of the band at 45*a* and 46*a*. The two head contacting elements 32*a* are secured to the band by wire or thread loops 41*a* which in this instance may extend through the band and about wire 42*a* to assure effective retention of elements 32*a***, but with those elements being free for universal pivotal movement in the same manner discussed in connection with the first form of the invention.

Figure 8:
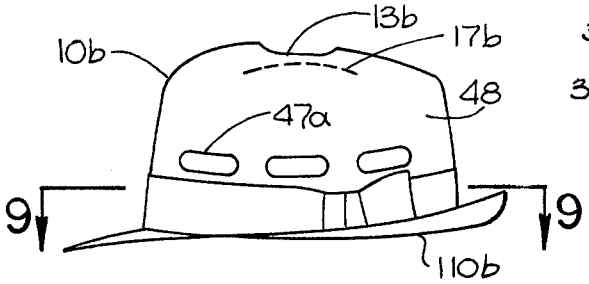
FIG. 8 is a side view of a hat embodying some of the features of the invention.
Figure 9:
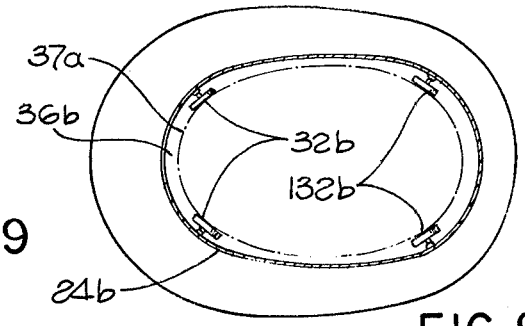
FIG. 9 is a horizontal section on line 9—9 of FIG. 8.

FIG. 8 shows another variational arrangement in which a hat 48 has a crown **10*b* containing a top aperture 13*b* and flexibly mounted baffle 17*b* therebeneath. the crown 10*b* of FIG. 8 also contains side apertures 47*a* similar to apertures 47 of FIG. 1, and has a brim 110*b* extending continuously about the bottom of the hat. This hat of FIG. 8 does not have an adjusting strap to vary the size of the band, but must be purchased to fit a particular size head. Also, in the FIGS. 8 and 9 arrangement, the hat band 24*b* and the portion of the crown to which it is connected may have sufficient stiffness to maintain their shape effectively without the necessity for provision of wires corresponding to those shown at 42 in FIG. 3 or 42*a* in FIG. 6. As seen in FIG. 9, the band 24*b* carries two head contacting elements 32*b* engageable with the front of the user's head, and also preferably carries two addtional spaced head contacting elements 132*b* at the rear of the hat for engaging the back side of the head at that location, to maintain a gap 36*b* between the hat band and head 37*b* continuously entirely about the head. Each of the elements 32*b* and 132*b* may be constructed the same as elements 32 and 32*a* of the other forms of the invention, and may be mounted for universal pivotal movement in the same manner as elements 32 and 32*a***, to be automatically pivotable to whatever position is necessary for best engagement with the user's head.

Figure 10:
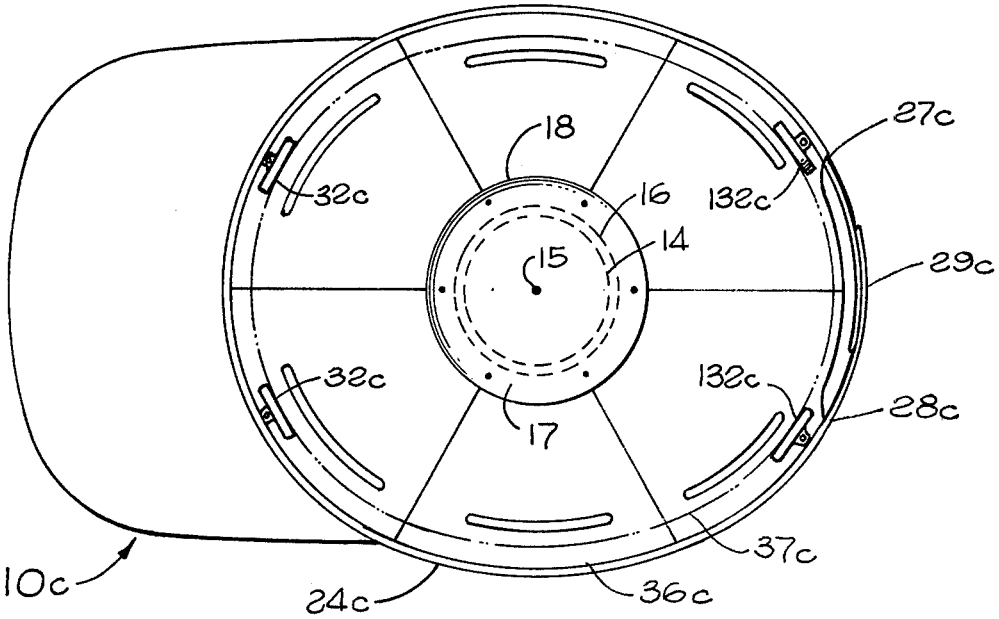
FIG. 10 is a bottom view of another variation.

FIG. 10 is a bottom view similar to FIG. 2 of another variational cap **10*c*, which may be identical with the cap of FIGS. 1 to 5 (or FIGS. 6 and 7) except that, as in FIGS. 8 and 9, two additional head contacting elements 132*c* are provided at the rear of the cap, besides the front elements 32*c*. All four of these elements are mounted for universal adjusting movement as previously discussed, with the two rear elements 132*c* desirably being connected to the hat band near its opposite ends 27*c* and 28*c* (corresponding to locations 27 and 28 of FIG. 2), i.e. at locations at which the band is reinforced by a wire or wires corresponding to wires 42 or 42*a* of FIGS. 3 and 6 but near the extremities of those wires. Adjusting straps 29*c* are provided at the rear of the cap, and are adjusted to maintain all four elements 32*c* and 132*c* in contact with the head 37*c* while those elements keep the band 24*c* in spaced relation to the user's head to provide an air circulation gap 36*c*** continuously about the head.

Figure 11:
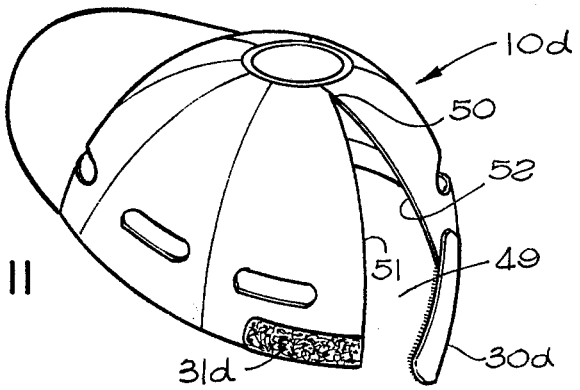
FIG. 11 is a perspective view of a further variation.
Figure 12:
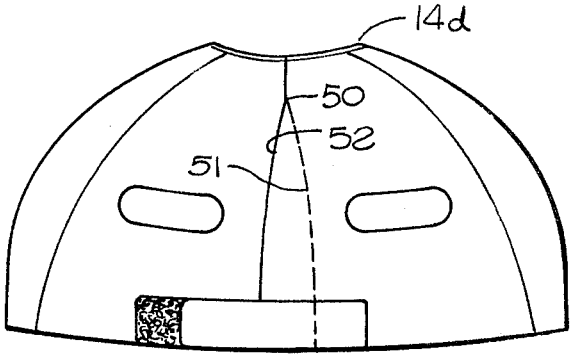
FIG. 12 is a rear view of the FIG. 11 cap.

FIGS. 11 and 12 show another cap **10*d*, which may correspond to that shown at 10 in FIG. 1, or 10*c* in FIG. 10, except that the back of the cap contains a slit 49 which extends upwardly from the bottom edge of the rear portion of the cap to a location 50 very near the top opening 14*d*. This slit 49 is defined by two edges 51 and 52, which are separable from one another as shown in FIG. 11 and can be retained in different relatively adjusted positions by attachment of a velcro strap 30*d* secured to one side of the slit to a second velcro element 31*d* at the other side of the slit. Internally, the cap 10*d* has universally pivotable elements such as those shown at 32 and 32*c*, with additional rear elements 132*c*** if desired, and with the reinforcing wires in the band as discussed.

The cap of FIGS. 11 and 12 is especially designed for use by women, to enable the cap to be put on and off without disarranging the coiffure. In placing the hat on, the user can first detach the velcro elements **30*d* and 31*d* to enable the back of the cap to be opened widely, after which she can place the front portion of the cap against her forehead and then wrap the sides and back about the head for retention by the velcro elements in a properly adjusted position such as that shown in FIG. 12. In that applied condition, the edges 51 and 52 may overlap slightly as shown in FIG. 12**, or may be spread slightly apart as necessary to bring the universally pivotable spacer elements into engagement with the head.

While certain specific embodiments of the present invention have been disclosed as typical, the invention is of course not limited to these particular forms, but rather is applicable broadly to all such variations as fall within the scope of the appended claims.

I claim:

1. A hat or cap comprising:

a crown structure adapted to extend across the top of a user's head and downwardly about the user's head and containing an opening at the top of the crown structure;

a baffle spaced beneath an upper portion of said crown structure at a location downwardly opposite said opening in the crown structure and past which air may flow between the interior of said crown structure and said opening for communication therethrough with the exterior of the crown structure; and flexible means supporting said baffle from said upper portion of the crown structure in vertically spaced relation and adapted to permit upward movement of the baffle relative to the upper portion of the crown structure and contained opening when contacted by a user's head.

2. A hat or cap as recited in claim 1, in which said flexible means include a plurality of spaced flexible connectors secured at upper ends to said upper portion of the crown structure and hanging downwardly therefrom and having lower ends connected in suspending relation to said baffle.

3. A hat or cap as recited in claim 1, in which said flexible means include thread connected to said upper portion of the crown structure at spaced locations and hanging downwardly therefrom and connected to said baffle to suspend it while enabling upward deflection of the baffle by a user's head.

4. A hat or cap comprising:

a crown structure adapted to extend across the top of a user's head and downwardly about the user's head;

a hat band structure at the bottom of said crown structure and adapted to extend across the front of the head and rearwardly at its sides;

a plurality of spacer elements projecting inwardly from said hat band structure and adapted to be recieved near the front of the user's head and to engage the user's head in a relation holding the hat band structure in spaced relation thereto to allow for air circulation between the head and hat band structure; and an adjustable connection between different portions of the hat band structure near the back of the head for varying the effective side of the hat band structure to different head sizes;

said hat band structure including flexible material extending along the front and sides of the head, and an elongated stiffening member secured to and having greater stiffness than said flexible material and extending across the front of the user's head between said elements in spaced relation to the head and then extending rearwardly from the locations of said elements and along opposite sides of the user's head, and acting to maintain the shape of the hat band structure as it extends near the user's head but in spaced relation thereto;

each of said spacer elements having a head contacting portion and a reduced dimension portion projecting outwardly therefrom and containing an opening; and a connecting element extending about said stiffening member and extending through said opening of one of the spacer elements in a relation mounting the spacer element for universal pivotal movement relative to the hat band structure.

5. A hat or cap as recited in claim 4, in which said connecting element is a wire loop extending about said stiffening member and through said opening of a spacer element.

6. A hat or cap as recited in claim 4, in which said connecting element is formed of thread sewed to said hat band structure and about said stiffening member and through said opening of a spacer element.

7. A hat or cap comprising:

a crown structure adapted to extend across the top of a user's head and downwardly about the user's head;

a hat band structure at the bottom of said crown structure and adapted to extend across the front of the head and rearwardly at its sides;

a plurality of spacer elements projecting inwardly from said hat band structure and adapted to engage the user's head in a relation holding the hat band structure in spaced relation thereto to allow for air circulation between the head and hat band structure;

said spacer elements having head contacting portions and having outer portions with openings extending therethrough; and connecting means attached to said hat band structure and extending through said openings in said outer portions of said spacer elements and attaching said elements to said hat band structure for universal pivotal movement relative to the hat band structure;

said hat band structure including flexible hat band material and a stiffening member secured thereto and extending therealong;

said connecting means including a connecting element extending about said stiffening member and through said opening of one of the spacer elements in a relation mounting the spacer element for universal pivotal movement.

8. A hat or cap as recited in claim 7, in which said connecting element is a wire loop extending about said stiffening member and through said opening of a spacer element.

9. A hat or cap as recited in claim 7, in which said connecting element is formed of thread sewed to said hat band structure and about said stiffening member and through said opening of a spacer element.

10. A hat or cap as recited in claim 7, in which said head contacting portions of the spacer elements, and also said outer portions thereof which contain said openings, are both located at the inner side of said hat band structure, said connecting means extending from said hat band structure inwardly toward the user's head and passing through said opening at the inner side of the hat band structure.

11. A hat or cap comprising:

a crown structure adapted to extend across the top of a user's head and downwardly about the user's head;

a hat band structure at the bottom of said crown structure and adapted to extend across the front of the head and rearwardly at its sides;

a plurality of spacer elements projecting inwardly from said hat band structure and adapted to be received near the front of the user's head and to engage the user's head in a relation holding the hat band structure in spaced relation thereto to allow for air circulation between the head and hat band structure; and an adjustable connection between different portions of the hat band structure near the back of the head for varying the effective size of the hat band structure to different head sizes;

said hat band structure including flexible material extending along the front and sides of the head, and an elongated stiffening member secured to and having greater stiffness than said flexible material and extending across the front of the user's head between said elements in spaced relation to the head and then extending rearwardly from the locations of said elements and along opposite sides of the user's head, and acting to maintain the shape of the hat band structure as it extends near the user's head but in spaced relation thereto;

said stiffening member being interrupted at the location of said adjustable connection, and having rear extremities at opposite sides of said connection which are movable relatively toward and away from one another as the effective size of the hat band structure is varied to attain proper contact of said spacer elements with the user's head.

12. A hat or cap as recited in claim 11, including means attaching said spacer elements movably to said stiffening member.

13. A hat or cap as recited in claim 11, in which there are two of said stiffening members secured to said flexible hat band material at vertically spaced locations and both extending across the front of the user's head and rearwardly at opposite sides thereof.

14. A hat or cap as recited in claim 11, in which said spacer elements have head contacting portions and universal connections mounting said head contacting portions for universal pivotal movement relative to said hat band structure.

15. A hat or cap as recited in claim 11, in which each of said spacer elements has a head contacting portion and a reduced dimension portion projecting outwardly therefrom and containing an opening, there being connecting means attached to said hat band structure and extending through said opening in each of said spacer elements in a manner mounting the spacer elements for universal pivotal movement relative to the hat band structure.

16. A hat or cap as recited in claim 11, in which each of said spacer elements has a head contacting portion and a reduced dimension portion projecting outwardly therefrom and containing an opening, there being a wire attached to said hat band structure and extending through said opening in each of said elements in a relation mounting the elements for universal pivotal movement relative to the hat band structure.

17. A hat or cap as recited in claim 11, including two additional spacer elements projecting inwardly from the hat band structure near opposite ends of said stiffening element and near the back of the user's head for holding the hat band structure in spaced relation to the head at those locations, and connected to the hat band structure for relative universal pivoting movement.

18. A hat or cap comprising:

a crown structure adapted to extend across the top of a user's head and downwardly about the user's head;

a hat band structure at the bottom of said crown structure;

a plurality of spacer elements projecting inwardly from said hat band structure and adapted to engage the user's head in a relation holding the hat band structure in spaced relation thereto to allow for air circulation between the head and hat band structure;

said hat band structure including flexible material extending along at least the front and sides of the head, and an elongated stiffening member secured to and having greater stiffness than said flexible material and extending between said elements in spaced relation to the head, and acting to maintain the shape of the hat band structure as it extends near the user's head but in spaced relation thereto; and means attaching said spacer elements movably to said stiffening member.

* * * * *